US007934721B2

(12) United States Patent
De Marco et al.

(10) Patent No.: US 7,934,721 B2
(45) Date of Patent: May 3, 2011

(54) EQUIPMENT FOR TRANSFERRING SHEETS WITH CHANGE OF DIRECTION

(75) Inventors: Giuliano De Marco, Ivrea (IT); Alberto Massucco, Ivrea (IT); Francesco Terrusi, Milan (IT); Armando Aprato, Lugnacco (IT)

(73) Assignee: TECNAU s.r.l. (IT)

( * ) Notice: Subject to any disclaimer, the term of this patent is extended or adjusted under 35 U.S.C. 154(b) by 282 days.

(21) Appl. No.: 12/105,783

(22) Filed: Apr. 18, 2008

(65) Prior Publication Data

US 2008/0284089 A1 Nov. 20, 2008

(30) Foreign Application Priority Data

Apr. 20, 2007 (IT) ..... TO2007A0280

(51) Int. Cl.
*B65H 5/00* (2006.01)

(52) U.S. Cl. ..... 271/225; 271/69; 271/184; 271/198; 198/457.02

(58) Field of Classification Search ..... 198/457.02
See application file for complete search history.

(56) References Cited

U.S. PATENT DOCUMENTS 5,205,551 A * 4/1993 Nagano et al. ..... 271/225

FOREIGN PATENT DOCUMENTS

JP 05254641 A * 10/1993

* cited by examiner

*Primary Examiner* — Stefanos Karmis
*Assistant Examiner* — Gerald W McClain
(74) *Attorney, Agent, or Firm* — Banner & Witcoff, Ltd.

(57) ABSTRACT

An equipment for transferring sheets with change of direction for sheets entering along a first direction comprises output rollers to move the sheets along a second direction, right-angled with respect to the first direction, and members of engagement and movement, actuatable for engaging and moving the sheets entering along the first direction along the second direction up to the engagement with the output rollers. The members of engagement and movement provide a condition of reception in which define a space of reception for the entering sheets and a condition of engagement and movement in which engage the entered sheets and move the sheets for the engagement with the output rollers. The members of engagement and movement return to the condition of reception upon the engagement of the entered sheet with the output rollers for enabling a following sheet—to enter and to be moved along the first direction jointly with the movement of the previous entered sheet along the second direction.

7 Claims, 9 Drawing Sheets

EQUIPMENT FOR TRANSFERRING SHEETS WITH CHANGE OF DIRECTION

CROSS REFERENCE TO RELATED APPLICATION

This application claims priority from Italian Patent Application No. to 2007-000280, filed on Apr. 20, 2007, the subject matter of which is incorporated herein in its entirety by reference thereto.

TECHNICAL FIELD

The present invention relates to equipment for transferring sheets with change of direction. More specifically, the invention relates to equipment for transferring sheets with change of direction according to the introductory portions of the main claims.

BACKGROUND

Equipment for transferring sheets with change of direction, in particular right angle transfer equipment, are used in systems for the automatic processing and delivering of documents. Typically, the documents previously printed on sheets in vertical and in movement in the sense of a long edge should be moved in the sense of the short edge, without change of orientation for following processing of folding and insertion into envelope.

It is known equipment for transfer sheets with change of direction, of the type above mentioned, comprising a box like structure with a mechanism of input, a mechanism of output for moving the sheets along a second direction and electromagnets actuatable for putting the entered sheets in engagement with the mechanism of output. The mechanism of input includes a series of rollers which move the sheets along a first direction up to a stop surface, with loss of engagement. The mechanism of output includes motorized rollers projecting from a surface of support of the entering sheet and upper pinch rollers connected with the electromagnets. When the leading edge of the entering sheet arrives at the stop surface, it is sensed by a photocell which enables the electromagnets to urge the pinch rollers downwardly to put the entered sheet against the motorized rollers for the transfer along the second direction.

An equipment of this known type requires the complete emerging of the entered sheet along the second direction before the entering of a following sheet. Therefore this known equipment is inherently slow, of limited flexibility and is unsuitable to be used in the current high velocity systems for the automatic processing of document.

SUMMARY

The present disclosure provides equipment for transferring sheets with change of direction of high reliability, which results in fast, flexible and of relatively limited cost.

This object is obtained by the equipment for transferring sheets with change of direction for sheets entering along a first direction, comprising output rollers for moving the sheets along a second direction, right-angled with respect to the first direction. The equipment further comprises members of engagement and movement actuatable for engaging and moving the sheets entering along the first direction along the second direction up to the engagement with the output rollers. The members of engagement and movement provide a condition of reception in which define a space of reception for the entering sheets and a condition of engagement and movement in which engage the entered sheets and move the sheets for the engagement with the output rollers, and in which the members of engagement and movement return to the condition of reception upon the engagement of the entered sheet with the output rollers for enabling a following sheet to enter and to be moved along the first direction jointly with the movement of the previous entered sheet along the second direction.

According to another characteristic, the equipment for transferring sheets entering along a first direction comprises output rollers for moving the sheets along a second direction right angled with respect to the first direction an actuating motor and a pair or more pairs of cyclically actuatable opposite wheels to engage and move along the second direction, up to the engagement with the output rollers, the sheets entering along the first direction. At least a wheel has one or more sectors provided for engagement with the other wheel and one or more depressed sectors, and in which the sector is faced, or one of the depressed sectors is faced to the other wheel of the pair in a reference position to define a condition of receipt for the entering sheets, while the sector provided for engagement or each sector provided for engagement is designed to engage and move the sheets in the condition of engagement and movement. The actuating motor is provided to actuate at least a wheel from the reference position to positions of engagement and movement and return to the reference position, and each sheet entering along the first direction is moved up to the engagement with the output rollers by the one or more sectors provided for engagement, while a following sheet is allowed to enter and to be moved along a first direction up to the space defined by the depressed sectors for a new transferring of the sheets, jointly with the movement along the second direction of a sheet engaged by the output rollers.

Further according to another characteristic, the equipment for transferring sheets entering along a first direction comprises an input section, of reception of sheets entering along a first direction, output rollers for moving the sheets along a second direction, right angled with respect to the first direction and control and actuation means to put in engagement with the output rollers the sheets entered along the first direction. In particular, the equipment comprises: "O" rings of movement and contrast, lengthened along the first direction and having a lower branch tangent to a reference surface for engaging the entering sheets and moving the entering sheets along the reference surface; and members of engagement and movement of the said control and actuation means. The members of engagement and movement are operative in proximity of an edge of the sheets arranged on the reference surface, for moving the sheets up to the engagement with the output rollers.

According to another characteristic, the equipment for transferring sheets entering along a first direction comprises output members adjacent to a section of output for moving the sheets along a second direction, right angled with respect to the first direction. The equipment further comprises: a moving device for longitudinally moving the longitudinally entering sheets on a reference surface; members of engagement and movement for putting the longitudinally entered sheets in engagement with the output members along the reference surface; and transversal guide elements for guiding, along the second direction, transversely entering sheets entering transversely from an input section of the equipment, opposite to the section of output, adjacently and underneath the reference surface and up to the output members.

BRIEF DESCRIPTION OF THE DRAWINGS

The characteristics of the invention will become clear from the description that follows, given purely by way of non-limiting example, with reference to the attached drawings, in which.

DETAILED DESCRIPTION

Figure 1:
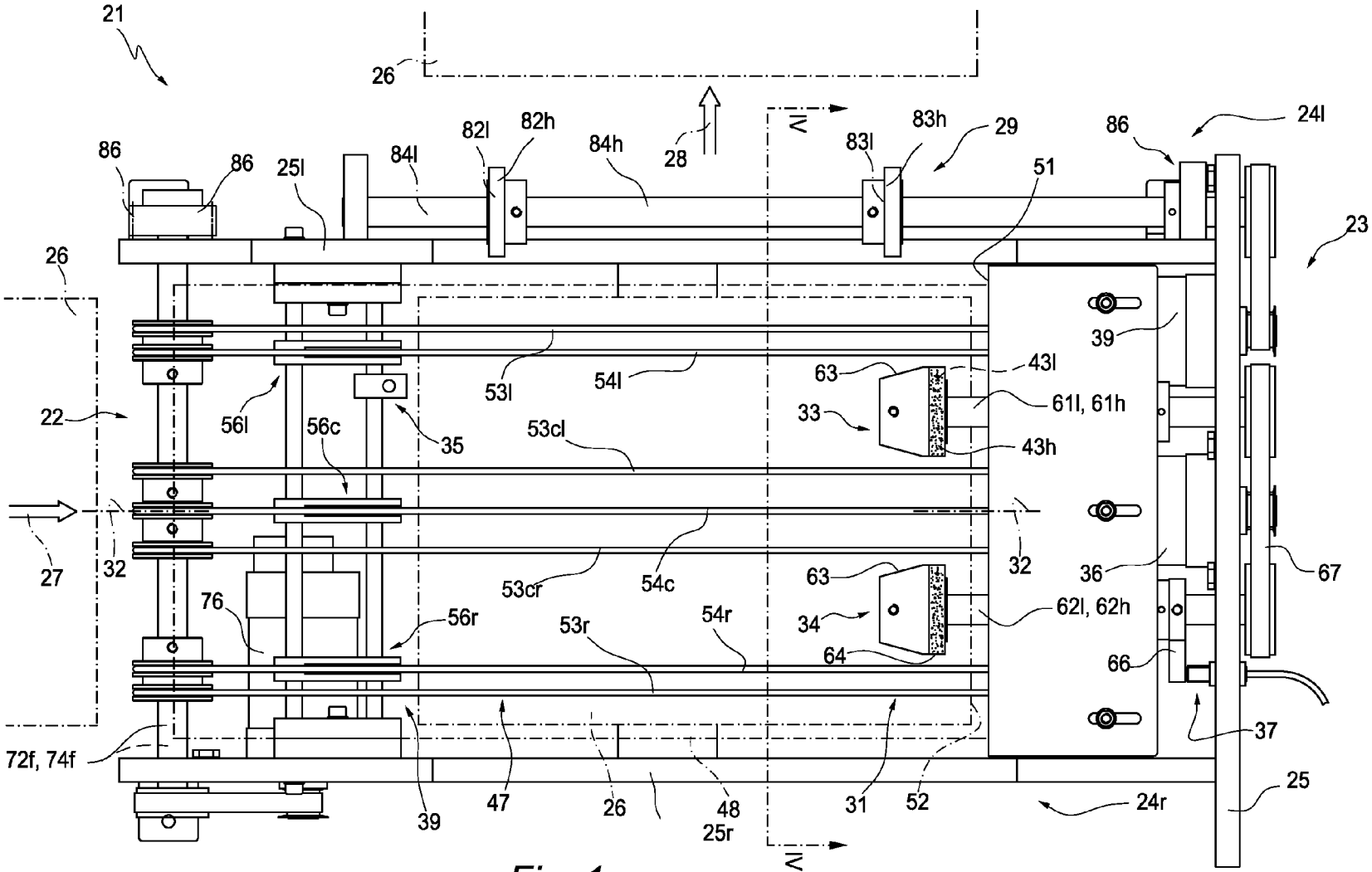
FIG. 1 represents a schematic plan view of an equipment for transferring sheets with change of direction according to the invention.
Figure 2:
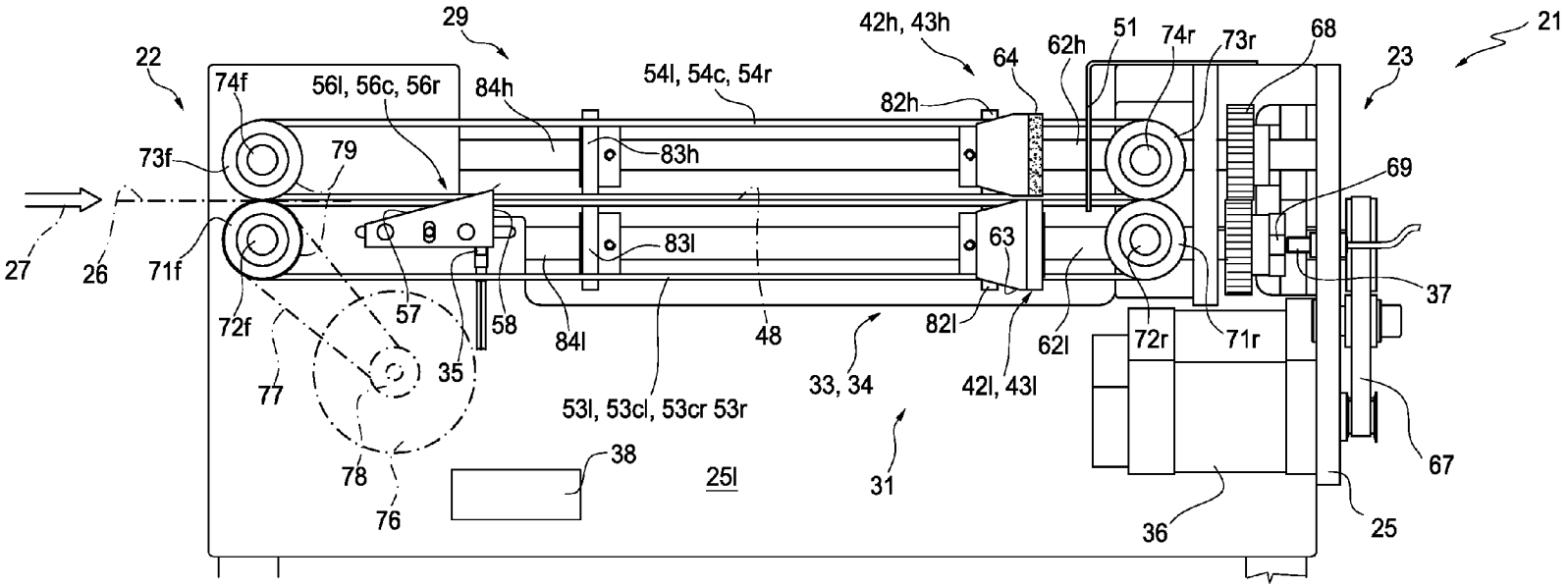
FIG. 2 shows schematically a sectioned lateral view of the equipment of FIG. 1.

With reference to the FIGS. 1 and 2, equipment for transferring sheets with change of direction is represented with 21. The equipment 21 comprises a front section 22, a back section 23 with a back wall 25 and lateral sections 24*l* and 24*r* with sides of support 25*l* and 25*r*.

The front section 22 is of input for the equipment 21 and is designed for receiving sheets, represented with 26, in movement along a first direction 27. The sheets 26 are sequentially receivable with short separation between the edge of output of an entering sheet and the input edge of a following one. The lateral section 24*l* is of output for the equipment 21 and in which, through the lateral section 24*l*, the entered sheets 26 emerge along a second direction 28, right angled with respect to the first direction 27.

For the movement along the second direction 28, the equipment 21 includes output members and control and actuation means 31. The output members comprise, for instance, opposite output rollers 29 for engaging the entered sheets 26 and moving the sheets along the second direction 28, while the control and actuation means 31 puts the entered sheets 26 in engagement with the output rollers 29.

The first direction 27 is parallel to a longitudinal axis 32 of the equipment. Such axis 32 is associated with the axis, conventionally longitudinal and of larger dimension, of the sheets 26, while the second direction 28 is associated to the transversal axis of smaller dimension of the sheets.

According to the invention, the control and actuation means 31 include members of engagement and movement 33 and 34, an actuating motor 36, a sheet sensor 35, a position sensor 37 and an electronic processing unit 38. The members of engagement and movement 33 and 34 are cyclically actuatable in the rotation, on control of the processing unit 38 for causing the entering sheets 26, which are moving along the first direction 27 to be temporarily engaged and moved, along the second direction 28, up to the engagement with the output rollers 29.

The sheet sensor 35 is arranged upstream of the members of engagement and movement 33 and 34. In turn, the members of engagement and movement 33 and 34 provide a condition of reception for receiving the sheets and a condition of engagement and movement in which engage the sheets and move the sheets for the engagement with the output rollers 29. The members 33 and 34 operate on areas of the sheets adjacent to the input edge and, immediately thereafter, return to the condition of engagement for allowing the superimposition of the sheet while the underlying sheet is transferring along the second direction. The output rollers 29 are arranged out of the trajectory of the sheets in movement along the first direction and are kept in continuous rotation by an output motor 39 for a quick transfer of the engaged sheets along the second direction.

Figure 5:
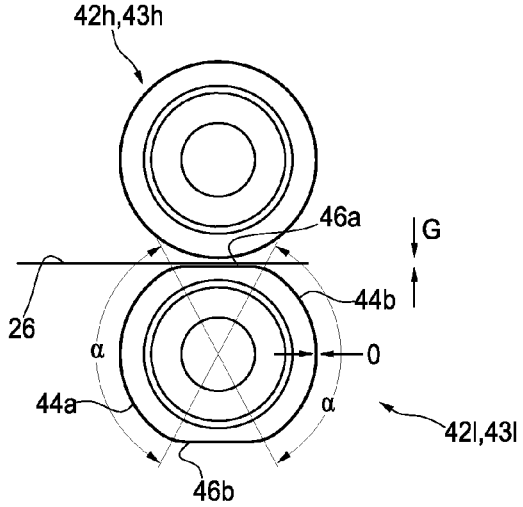
FIG. 5 is a partial view in enlarged scale of some details of FIG. 4.
Figure 5A:
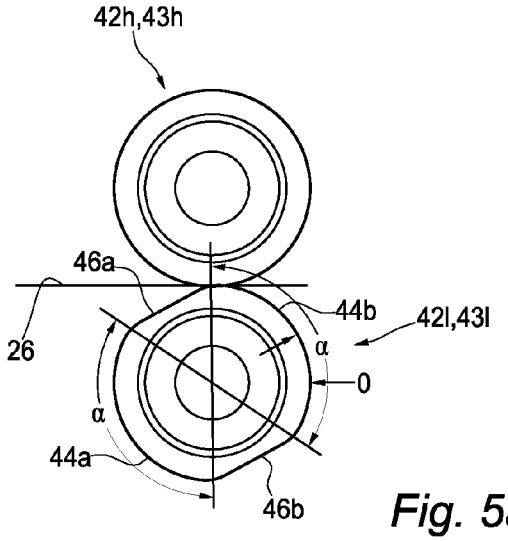
FIG. 5*a* shows the details of FIG. 5 in an operative condition.

The members of engagement and movement 33 and 34, respectively, include a pair of opposite wheels 42*l* and 42*h* and a pair of opposite wheels 43*l* and 43*h*, and in which the wheels 42*l*, 42*h* and 43*l* and 43*h* rotate around axes parallel to the longitudinal axis 32. The wheels 42*l* and 43*l* are conveniently shaped so as to define each one at least one sector, specifically two engagement sectors 44-*a*, 44-*b* (FIGS. 5*a* and 5*b*), for engaging the other wheel 42*h* and 43*h* and at least one depressed sector, specifically two depressed sectors 46-*a* and 46-*b*.

The engagement sectors 44-*a* and 44-*b* are arranged at 180° the one from the other and are designed for engaging the sheets 26 and pinching the sheets against the wheel 42*h* and 43*h* in the condition of engagement and movement. The depressed sectors 46-*a* and 46-*b* are also arranged at 180° the one from the other and face the other wheels 42*h* and 43*h* in respective angular reference positions "0". In the reference positions, the depressed sections are spaced apart a gap "G" with respect to the wheel 42*h* and 43*h* and the shaped wheels 42*l* and 43*l* define a condition of receipt for the entering sheets 26. The opposite wheels 42*l*, 42*h* and 43*l*, 43*h* are actuatable in the rotation from the reference positions "0" to angular positions of engagement and movement and return to the reference positions. The engagement sectors are sized so that, with the rotation, the sheet 26 is engaged and moved up to the engagement with the output rollers 29. After the engagement of the sheets, the wheels 42*l*, 42*h* and 43*l*, 43*h* continue the rotation for a cycle of 180° with arrest at the reference positions "0 " for receiving and transferring a following sheets According to the invention, the equipment 21 includes a longitudinal moving device 47 for moving, by adherence, the entering sheets 26 along the first direction 27 on a reference surface 48. In the condition of engagement and movement, the control and actuation means 31 engage and move the sheets 26 in the second direction on the reference surface 48, with respect to the moving device 47, up to the engagement with the output members.

In a first embodiment of the FIGS. 1 and 2, the equipment 21 includes, between the sides 25*l* and 25*r*, a stop plate 51 for the input edges 52 of the received sheets, lower "O" rings of moving and support 53*l*, 53*cl*, 53*cr* and 53*r* and upper "O" rings of movement and contrast 54*l*, 54-*c* and 54*r*. The "O" rings are lengthened along the first direction 27 and define the reference surface 48 for the entering sheets 26. Ramp and step elements 56*l*, 56*c* and 56*r* are associated to the lower "O"

rings of moving and support 53*l*, 53*cl*, 53*cr* and 53*r* and to the upper "O" rings of movement and contrast 54*l*, 54-*c* and 54*r* to overlap, without jamming, following sheets 26 on a sheet or on overlapped sheets of the reference surface 48.

Each ramp and step element 56*l*, 56*c* and 56*r* includes a ramp surface 57 and a step 58. The ramp 57 has a seat designed to receive the lower branch of the corresponding upper "O" rings of movement and contrast, while the sheet 26 or the overlapped sheets 26 are received and transferred, in plane, between the steps 58 of the ramp and step elements and the stop plate 51 according to a known technique.

The sheet sensor 35 is close to one of the steps 58 and recognizes the passage of the edge of output of the sheet received on the reference surface 48. The pairs of opposite wheels 43*l* and 43*h* are operative in proximity of the input edges 52 of the received sheets 26 lying on the reference surface 48 for moving the sheets up to the engagement with the output rollers 29.

The opposite wheels 42*l*, 42*h* and 43*l*, 43*h* project of few from the stop plate 51 for the engagement with the input edges 52 of the received sheets 26 and in proximity of the plate 51. The wheels 42*l*, 42*h* and the wheels 43*l* and 43*h* operate on two different areas adjacent at the edges of input 52, in conditions of synchronism. It ensures the transversal shifting of the sheets with constant orientation and without oscillations.

The opposite wheels 42*l*, 42*h* and 43*l*, 43*h* include each one a substantially frusto-conical tapered surface 63 for the received sheet 26. Each wheel 43*l*, 43*h* is provided of a peripheral band 64 in a material of high adherence for a sure pinching with the sheets 26 in the condition of engagement.

The wheels 42*l* and 42*h* of the member of engagement and movement 33 are mounted at the ends of two support shafts 61*l* and 61*h*, while the wheels 43*l* and 43*h* of the member of engagement and movement 34 are mounted at the ends of two support shafts 62*l* and 62*h*. The shafts 61*l*, 61*h* and 62*l*, 62*h* are mounted with the end projecting from the stop plate 51. The actuating motor 36 is of brushless D.C. type, with a position encoder 66 connected in the rotation with the support shafts 61*l* and 62*l* of the shaped wheels 42*l* and 43*l* and through a transmission belt 67. In turn, the shafts 61*l* and 62*l* are connected in synchronism with the support shafts 61*h* and 62*h* of the other wheels 42*h* and 43*h* through a chain of gears 68.

In the use, the processing unity 38 responds to a signal from the sheet sensor 35 to activate in intermittent way the actuating motor 36. The processing unity drives the motor 36 with a law of motion, which is optimized for a limited impact at the moment of the contact of the engagement sectors 44*a*, 44*b* with the sheet or with the sheets and against the other wheel 42*h*, 43*h*, for a high velocity when the sheet or the sheets are pinched between the opposite wheels and a quick return to the condition of receipt of the equipment.

The synchronous motorization between the lower wheels and the upper wheels assures pinching without slide both for the moving of single sheets and for the moving of overlapped sheets.

The position sensor 37 is designed to recognize the passage of an index 69 keyed on the shaft of support 61*l* of the shaped wheel 42*l* and to supply a zero signal "R". On initialization of the equipment 21, the processing unit 38 responds to the signal "R" to identify one of the reference angular positions "0" of the shaped wheels 42*l* and 43*l* and the condition of receipt for the entering sheets 26.

The longitudinal moving device 47 is defined by the lower "O" rings of moving and support 53*l*, 53-*c* and 53*r* and the upper "O" rings of movement and contrast 54*l*, 54-*cl*, 54-*cr* and 54*r*.

The "O" rings of moving and support 53*l*, 53-*c* and 53*r* are tensioned and moved by respective front lower pulleys 71*f* keyed on a shaft 72*f* and back lower pulleys 71*r* rotatable on a shaft 72*r*, while the "O" rings of movement and contrast 54*l*, 54*cl*, 54*cr* and 54*r* are tensioned and moved by front upper pulleys 73*f* keyed on a shaft 74*f* and back upper pulleys 73*r* rotatable on a shaft 74*r*. The shafts 72*f* and 74*f* are supported in rotatable way between the sides 25*l* and 25*r*. In turn, the stop plate 51 is arranged in front of the pulleys 71*r* and 73*r* and provides notches for the passage of the above described upper and lower "O" rings.

An input motor 76 rotates the lower pulleys 71*f* and the upper pulleys 73*f*, in synchronous way, through a transmission belt 77 and a pulley 78 keyed on the shaft 72*f* and through gears 79 between the shafts 72*f* and 74*f*. The received sheets 26 are arranged on the reference surface 48 and moved on this surface between the upper branches of the "O" rings of moving and support 53*l*, 53-*c* and 53*r* and the lower branches of the "O" rings of movement and contrast 54*l*, 54*cl*, 54*cr* and 54*r*.

Figure 6:
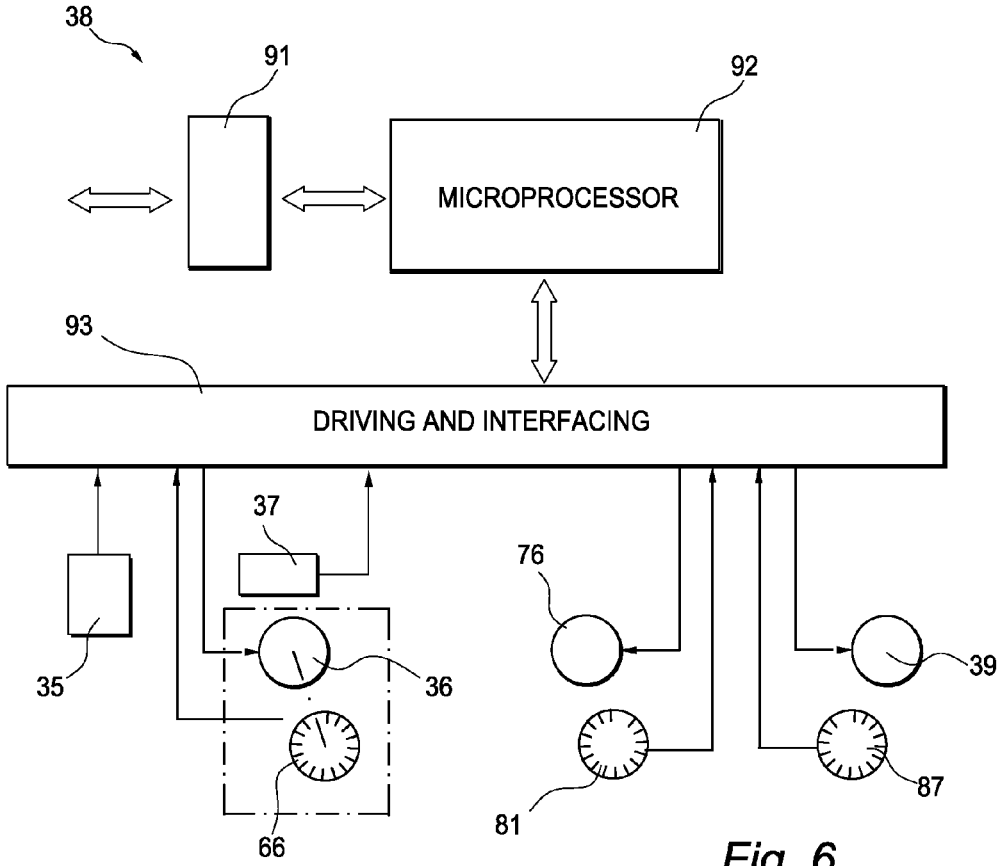
FIG. 6 is an electric block diagram of the equipment according to the invention.

The input motor 76 is of brushless D.C. type and is controlled by a position encoder 81 (FIG. 6) keyed on the shaft 72*f*. The processing unit 38 responds to the signals from the encoder 81 for regulating the moving speed of the sheets 26 on the basis of the requests of the equipment furnishing the entering sheets 26.

The longitudinal moving device 47 works on the opposite faces of a single sheet and, in the case of overlapped sheets, on the lower face of the underlying sheet and on the upper face of the upper sheet. It ensures the transfer of sheets overlapped in unitary ways and at high velocity. Thus, the equipment 21 can be arranged, advantageously, downstream of a so-called "double cutter" having possibility of cutting both of single sheets and of overlapped sheets. By means of the upper "O" rings, the device 47 provides to entering a sheet 26 on a sheet or sheets lying on the upper branch of the lower "O" rings.

The opposite output rollers 29 include a pair of rollers 82*l* and 82*h* a little upstream from the members 33 and 34 and a pair of rollers 83*l* and 83*h* of a little downstream from the ramp and step elements, keyed on a lower shaft 84*l* and on an upper shaft 84*h*. The shafts 84*l* and 84*h* are supported in the rotation at the outside of the side 25*f*, parallel to the axis 32 and so that the nipping area of the rollers 82*l* and 82*h* and of the rollers 83*l* and 83*h* results on the reference surface 48.

The output motor 39 is connected in the rotation with the lower shaft 84*l* through belt and pulley, while the upper shaft 84*h* is in synchronism with the shaft 84*l* through gears 86. Also the output motor 39 is of brushless D.C. type, controlled by a position encoder 87 keyed on the shaft 84*l*. The signals from the encoder 87 are used by the processing unit 38 to regulate the moving speed of the sheets 26 emerging along the second direction on the basis of the requests of the receiving equipments and the dimensions of the sheets.

The electronic processing unit 38 (FIG. 6) comprises an interface unit 91, a microprocessor 92 and a drive and interface unit 93. The interface unit 91 is connected to the system to which the equipment 21 is connected, while the microprocessor 92 works on the basis of information received by the system and in relation with the operative specifications of the sheets to be processed.

The processing unit 38 drives in continuous way the output motor 39 and the input motor 76 on the basis of information of velocity and control of the signals from the encoders 87 and 81. Moreover, the unit 38 drives the actuating motor 36 in response to signals from the sheet sensor 35, according to a cycle of engagement, movement and release of the shaped wheels with respect to the sheets 26. This cycle provides a period of movement with steps of acceleration and brake and a period of arrest associated to the movement of the sheet along the second direction, with control by the position encoder 66 and return to the reference positions "0."

The structure of the equipment 21 allows the transferring of single sheets and overlapped sheets and with liberty on the number of the overlapped sheets and the transferring of bundles of sheets, by adjusting the distance between the wheels 42*l* and 42*h* and the wheels 43*l* and 43*h*.

In the operation for the transferring of sheets, the equipment 21 is in a condition of reception in which the input motor 76 is energized for the actuation of the "O" rings 53*l*, 53*cl*, 53*cr* and 53*r* and of the "O" rings 54*l*, 54-*c* and 54*r*. At the same time, the output motor 39 is energized for a continuous rotation of the output rollers 29. In turn, the shaped wheels 42*l* and 43*l* (FIG. 5*a*) are in the reference positions, spaced apart of the gap "G" from the opposite wheels 43*l* and 43*h*.

Figure 2A:
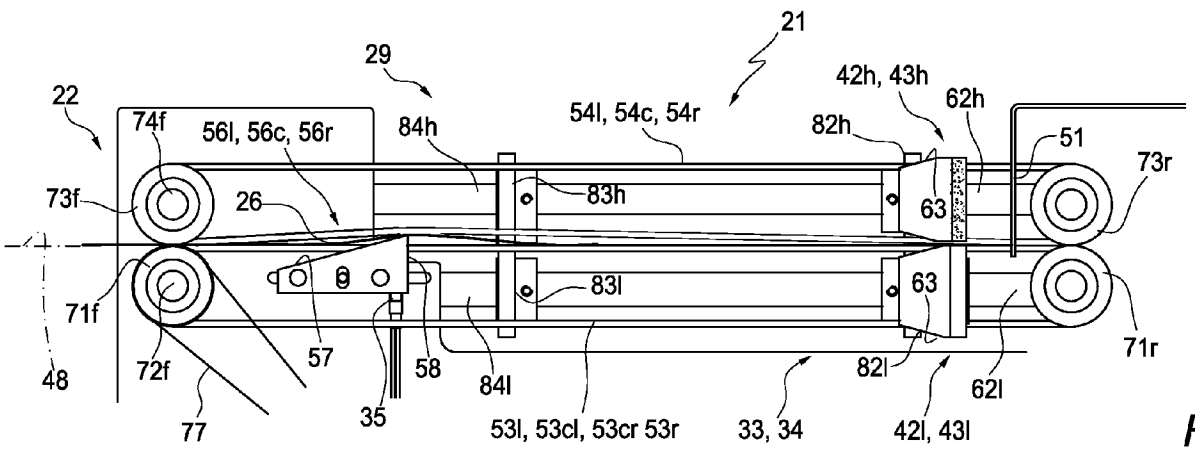
FIG. 2*a* is a portion of the view of FIG. 2 in an operative condition of the equipment.
Figure 3:
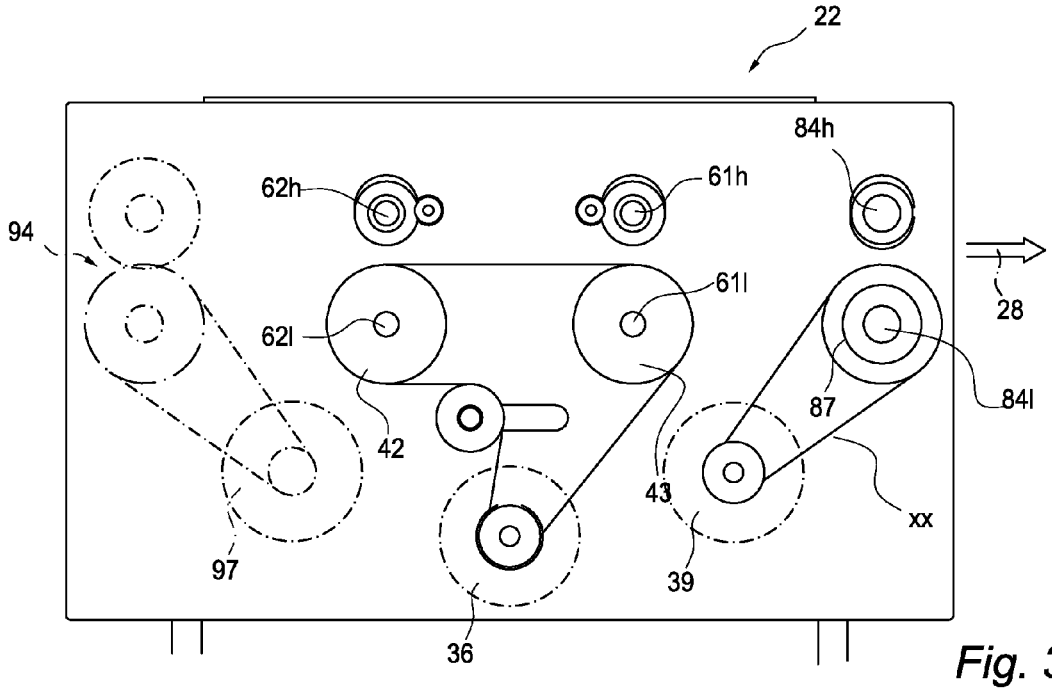
FIG. 3 is a back partial view of the equipment of FIG. 1.

A sheet 26 entering in the input section 22 is nipped between the upper branches of the "O" rings 53*l*, 53*cl*, 53*cr* and 53*r* and the lower branches of the "O" rings 54*l*, 54-*c* and 54*r*. The "O" rings move the sheet along the first direction 32, with lifting of the input edge on the ramp and step elements 56*l*, 56*c* and 56*r*, following lending on the reference surface 48 (FIG. 2*a*) and moving on the surface 48. Upon the passage of the edge of output in front of the sheet sensor 35, the processing unit 38 (FIG. 6) activates the actuating motor 36 for a cyclical rotation of 180 degrees of the wheels 42*l*, 42*h* and 43*l*, 43*h*. It occurs jointly with the input edge 52 entering the gaps "G" between the wheels 42*l* and 42*h* and the wheels 43*l* and 43*h*.

The stop plate 51 holds back the sheet 26, against the sliding action of the "O", while the sectors 44° and 44*b* of the shaped wheels 42*l* and 43*l* engage, in tandem, two areas of the sheet adjacent to the input edge 52. The entered sheet 26 is moved in the second direction 28, carrying the lateral edge up to the engagement with the output rollers 29. The rollers 29 now drag the sheet in the second direction 28, while the shaped wheels 42*l* and 43*l* return to the condition of receipt.

During the movement of the entered sheet 26 in the second direction, the equipment 21 can receive and moving longitudinally a following sheet 26. The input edge 52 of the following entering sheet will be lifted by the ramp and step elements 56*l*, 56*c* and 56*r*, and subsequently depressed with partial superimposition on the sheet 26 lying on the reference surface 48 and emerging from the equipment. While the preceding sheet completely disengages the upper and lower "O" rings, the following sheet enters the gaps "G", for a new energization of the actuating motor 36, on the passage of the edge of output of the sheet in front of the sheet sensor 35, and another cycle of transferring.

The above described transferring of sheets also applies to the receiving of two overlapped sheets, as in the case in which the equipment 21 is arranged downstream of a double cutter.

The equipment 21 can also operate for forming a bundle of sheets in the space defined between the steps 58 of the ramp and step elements and the stop plate 51, with the edges 52 received in the gaps "G". In this case, the processing unit 38 will drive the actuating motor 36 after the reception of a number of signals from the sheet sensor 35 corresponding to the number of sheets which will form the bundle. The whole bundle will be moved by the wheels 42*l* and 42*h* and the wheels 43*l* and 43*h* up to the output rollers 29 for the following transferring in the second direction.

Figure 4:
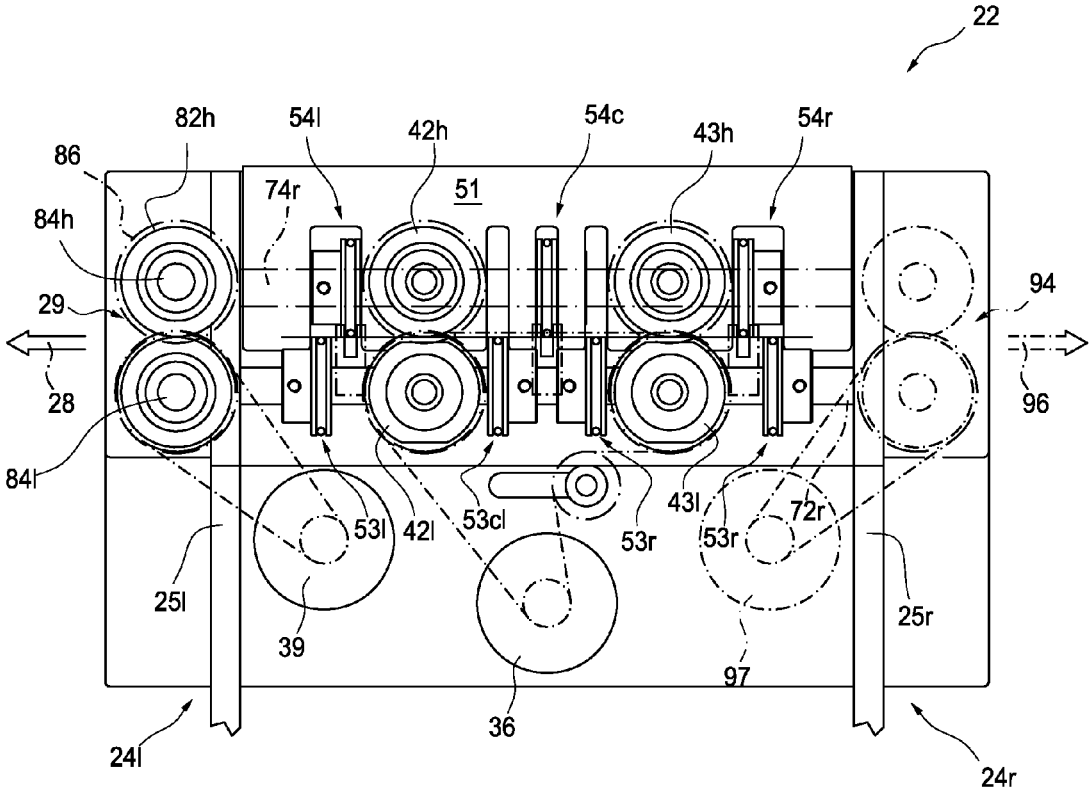
FIG. 4 shows schematically a partial section of the equipment of the invention according to the line IV-IV of FIG. 1.

The equipment 21 can optionally provide output rollers 94 (FIGS. 4 and 5) arranged adjacent to the side 25*r* and having sense of rotation opposed to the one of the rollers 29 to transfer the sheets 26 from the section 24*r* of the equipment along the second direction but in an opposite sense 96. In this way, for a given sense of rotation of the wheels 42*l*, 43*l*, the sheets will be transferred with emersion from the lateral section 24*l*, while the sheets will be transferred with emersion from the section 24*r* for a sense of rotation opposed of the wheels 42*l*, 43*h*.

Figure 7:
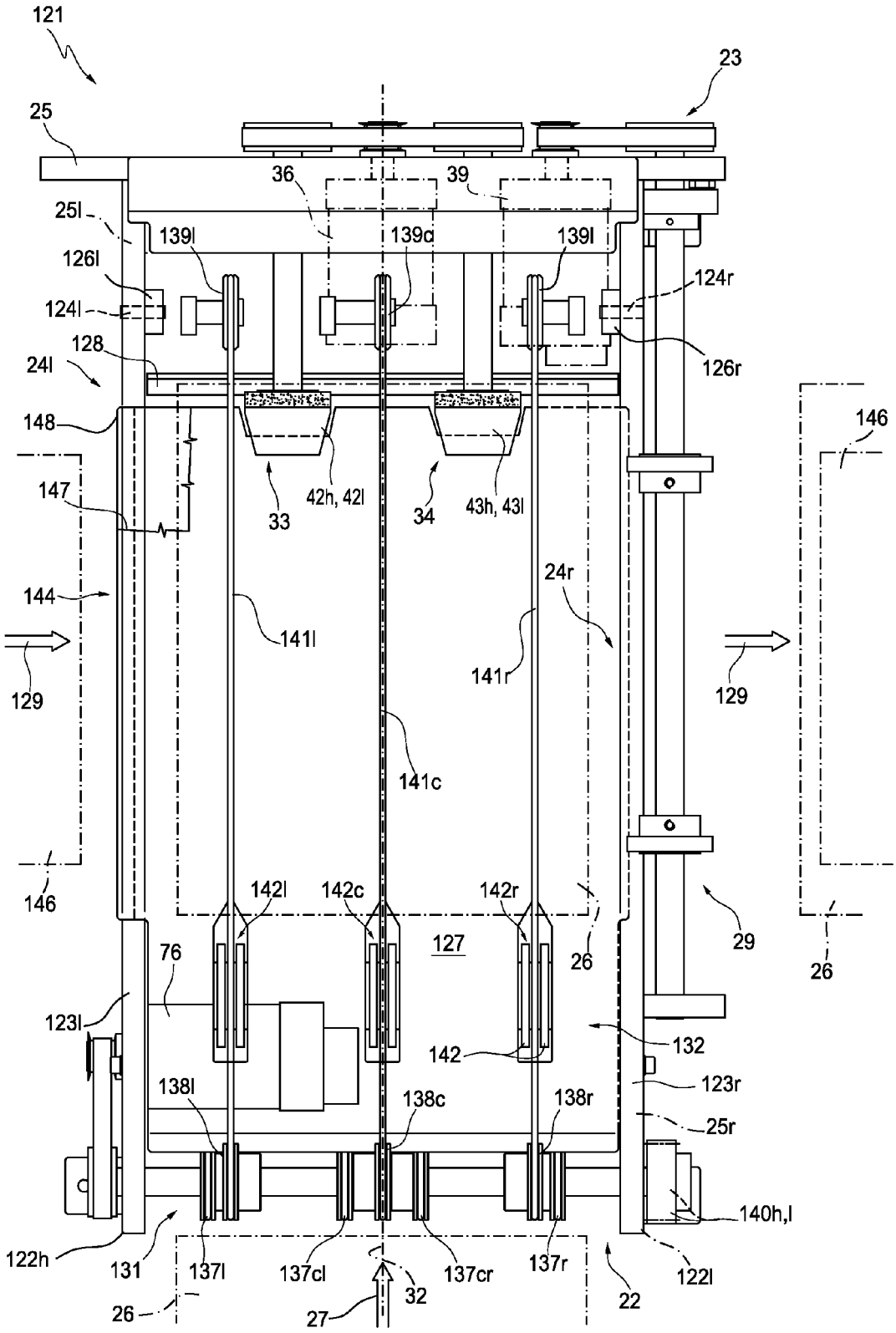
FIG. 7 shows a schematic plan view of a variant of the equipment of FIG. 1.
Figure 8:
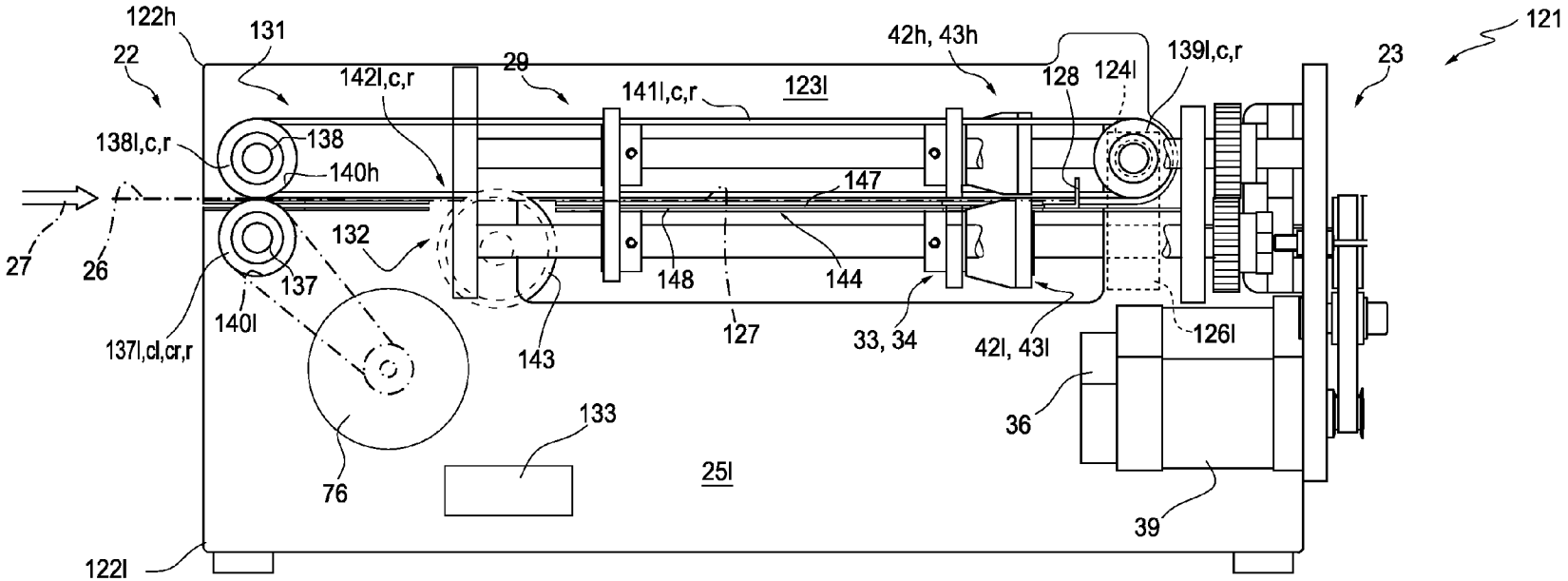
FIG. 8 represents a schematic sectioned lateral view of the equipment of FIG. 7.
Figure 9:
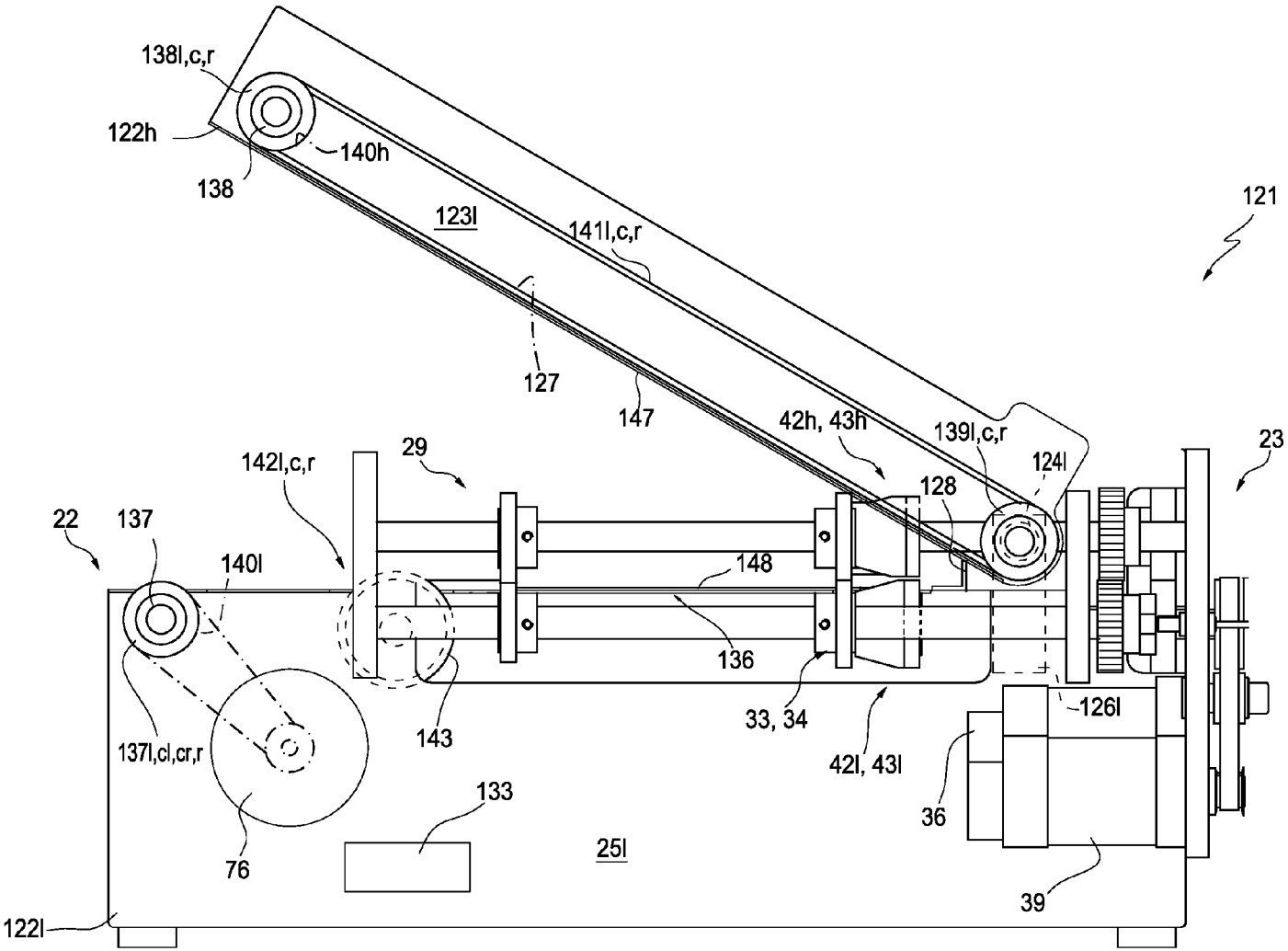
FIG. 9 shows the lateral view of FIG. 8 in a condition of service.

With reference to the FIGS. 7, 8 and 9, is represented with 121 a variant of equipment for transferring sheets with change of direction, similar to the equipment 21 of FIG. 1, including a fixed lower frame 122*l* and a mobile upper frame 122*h*, and in which the upper frame 122*h* is provided for being positioned between an operative position and a position of service. In detail, the lower frame 122*l* includes the back wall 25 and the sides 25*l* and 25*r*. The mobile frame 122*h* has two sides 123*l* and 123*r* lined up with the sides 25*l* and 25*r* and is fulcrumed on the frame 122*l* through pivots 124*l* and 124*r* and lugs 126*l* and 126*r* adjacent to the back section 23. In the operative position (FIG. 8), the frame 122*h* is horizontal, with the lower edges of the sides 1231 and 123*r* in contact with the upper edges of the sides 25*l* and 25*r*, while the section 22 corresponds to the front portion of the frames 122*l* and 122*h*. In the position of service (FIG. 9), the frame 122*h* is inclined upwardly with respect to the frame 122*l* and allows the access to the frame 122*l* and the lower components.

The equipment 121 presents a reference surface 127 defined in the upper frame 122*h* and a stop surface 128 defined in the lower frame 122*l*, for the sheets 26 entering along the first direction 27. In the operative position of the frame 122*h*, the reference surface 127 is horizontal, arranged between the front section 22 and the back section 23, while the stop surface 128 is adjacent to the section 23. The lateral section 24*r* is of output for the equipment 121 and, through this lateral section, the sheets 26 emerge along a second direction 129, right angled with respect to the first direction 27 and according to the transversal axis of the sheets 26.

The equipment 121 comprises functional components equal to the functional components of the equipment 21, including the opposite output rollers 29, the members of engagement and movement 33 and 34 and the relative sensors and different functional components, including a longitudinal moving device 131, edge lifting elements 132 and an electronic processing unit 133.

The longitudinal moving device 131 is actuated by an input motor 76 for moving the entering sheets 26 along the first direction 27 on the reference surface 127. The edge lifting elements 132 are arranged at the input and are associated to the moving device 131 for overlapping, without jamming, following entering sheets on the sheet of the reference surface 127 or on sheets overlapped of the surface 127. The output rollers 29 are kept in continuous rotation by the output motor 39 to engage the sheets 26 and move the sheets along the second direction 129.

The moving device 131 includes, arranged in vertical, input pulleys 137*l*, 137*cl*, 137*cr* and 137*r*, front pulleys, 138*l*, 138*c* and 138*r*, back pulleys 139*l*, 139*c* and 139*r* and "O" rings or belts of movement and contrast, in detail "O" rings 141*l*, 141*c* and 141*r*, between the front and back pulleys.

The input pulleys, 137*l*, 137*cl*, 137*cr* and 137*r* are keyed on a shaft 137 of the frame 122*l* and, in the operative condition of the frame 122*h*, these pulleys are below and in condition of tangency with respect to the reference surface 127. The front pulleys, 138*l*, 138*c* and 138*r* are keyed on a shaft 138 of the frame 122*h* and are arranged above and tangent with respect to the reference surface 127. The back pulleys 139*l*, 139*c* and 139*r* are coaxial with the pivots 124*l* and 124*r* of fulcrum for the frame 122*h* and are supported in rotatable way by lugs of the frame 122*l* adjacent to the back section 23. The pulleys

139*l*, 139*c* and 139*r* are arranged above and in condition of tangency with respect to the surface 127.

The input pulleys 137*l*, 137*cl*, 137*cr* and 137*r* are connected in the rotation with the input motor 76 through the shaft 137 and through pulleys and a toothed belt. In the operative condition of the frame 122*h*, the motor 76 also actuates the front pulleys, 138*l*, 138*c* and 138*r* through the shaft 137 and a pair of gears including a gear 140*l* keyed on the shaft 137 and a gear 140*h* keyed on the shaft 138. With reference to the FIG. 7, the pulley 138*l* is arranged at the right of the pulley 137*l*, the pulley 138 is in central position between the pulleys 137*cl* and 137*cr* and the pulley 138*r* is at the left of the pulley 137*r*. In the condition of service of the frame 122*h* (FIG. 9), the gear 140*h* is disengaged from the gear 140*l*.

Figure 8A:
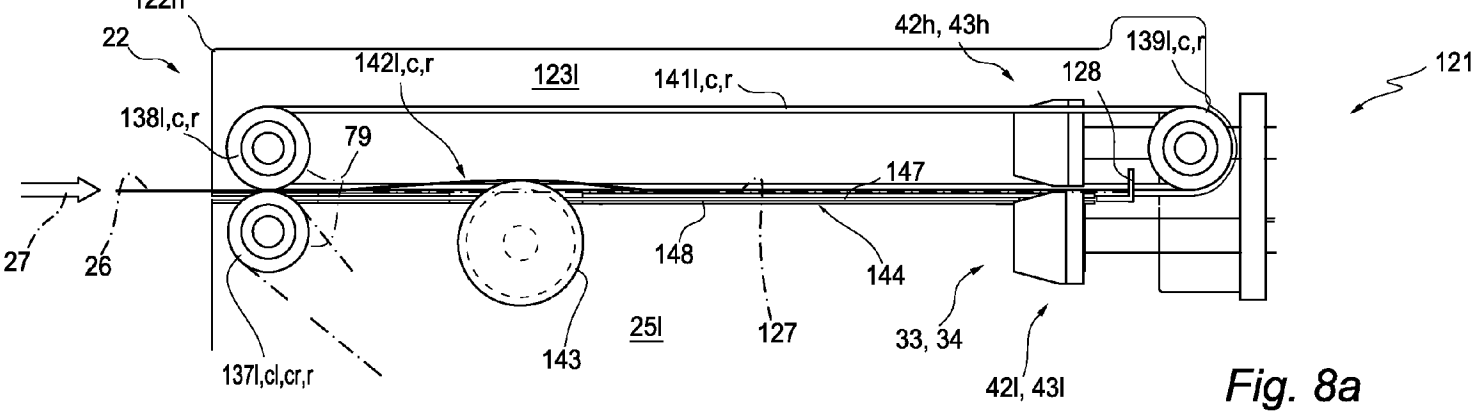
FIG. 8*a* is a portion of the view of FIG. 8 in an operative condition.

The "O" rings of movement and contrast 141*l*, 141*c* and 141*r* (FIGS. 7, 8 and 8*a*) are longitudinally lengthened, engaged between the front pulleys, 138*l*, 138*c* and 138*r* and the back pulleys 139*l*, 139*c* and 139*r*. The lower branches of the "O" rings 141*l*, 141*c* and 141*r* are adjacent to the reference surface 127 and, in the use, are designated for cooperating with the sheets 26 of the reference surface 127 for longitudinally moving the sheets along the surface 127.

The edge lifting elements 132 include lower contrast pulleys 142*l*, 142*c* and 142*r*, mounted on the frame 122*l*, and which are designed to cooperate with the "O" rings 141*l*, 141*c* and 141*r*. Each pulley 142*l*, 142*c* and 142*r* is provided of a notch with small sides 143. In the operative condition of the frame 122*h*, the notches of the pulley 142*l*, 142*c* and 142*r* are coupled with the lower branches of the "O" rings 141*l*, 141*c* and 141*r*, while the small sides 143 project of few from the surface 127.

According to an embodiment of the invention, the equipment 121 includes transversal guide elements 144 for transversely entering sheets 146 from the lateral sections 24*l*. The section 24*l* represents a transversal input, opposite to the sector 24*r*, of output, along the second direction 129, for the transfer without change of direction up to the output members 29. Specifically, the guide elements 144 can guide sheets 146 of large transversal dimensions, also through the space of reception between the wheels 42*l*, 42*h* and 43*l*, 43*h*, up to the output rollers 29, for moving these sheets along the second direction 129.

In particular, the transversal guide elements 144 include an upper laminar guide 147 and a lower laminar guide 148. The guide 147 is mounted on the bottom of the mobile frame 122*h*, adjacent to the lower branches of the "O" rings, and defines the reference surface 127, while the guide 148 is mounted on an upper portion of the frame 122 parallel, in the use, with the guide 147. Thus, the guides 147 and 148 form, in the operative conditions, a passage for the sheets 146 underneath the reference surface 127. The laminar guides 147 and 148 include, where necessary, suitable openings to freely lodge the contrast pulleys 142*l*, 142*c* and 142*r* and the shaped wheels 42*l*, 42*h* and 43*l*, 43*h*.

According to the invention, the equipment 121 can be associated or can integrate a transversal insertion device for entering the sheets 146 through the transversal guide elements 144.

In alternative and without mechanical changes, the equipment 121 can longitudinally introduce the sheets 26 and move the sheets along the second direction 129 with right angled change of direction, or receive and transversally transfer the sheets 146 without change of direction. In the condition of service of the frame 122*h*, the operator can access the lower laminar guide 148 for the removal of possible jammed sheets.

Figure 10:
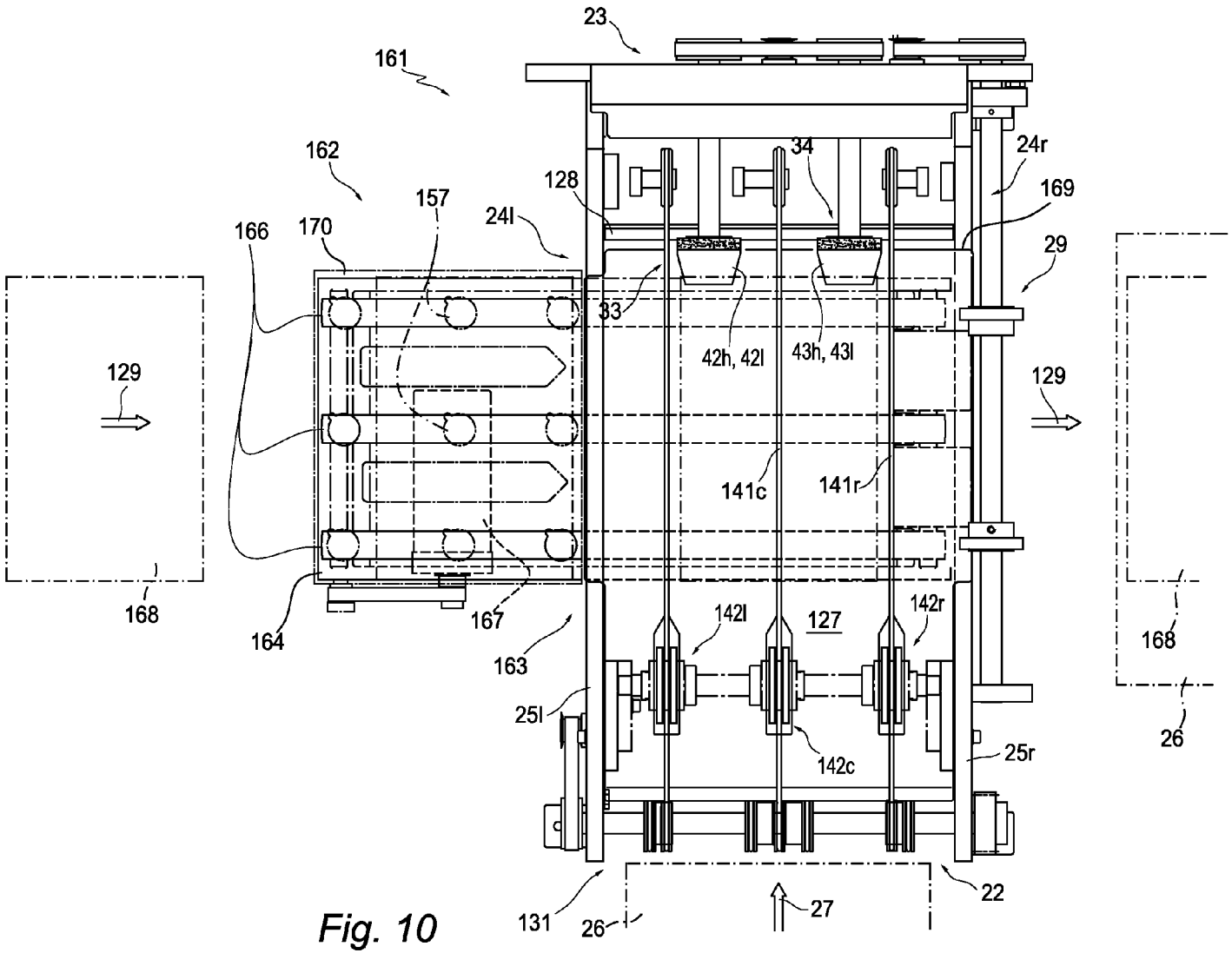
FIG. 10 represents a schematic plan view of another variant of the equipment of FIG. 7 in a particular operative configuration.

An equipment for transferring sheets 161 according to the invention is shown in FIG. 10. The equipment 161 is similar to the equipment 121 and integrates a transversal insertion device, represented with 162. With respect to the equipment 121, the equipment 161 has differences regarding some component of the transversal guide elements, herein represented with 163. The device 162 includes a support plate 164, transport belts 166 with upper branches slideable on the plate 164 and a transversal input motor 167 controlled by the electronic unit 133 for the feeding of the belts 166.

The insertion device 162 presents a section external to the equipment 161 and an internal section. In the external section, the plate 164 and the belts 166 transversally project from the lateral section 24*l* and are designed for receiving sheets 168 to be transferred without change of direction. In the internal section, the plate 164 and the belts 166 form the lower portion of the transversal guide elements 163. The upper portion of the elements 163 is formed by an upper laminar guide 169 equal to the guide 147 of FIG. 8. Thus, in the operative conditions, the plate 164 and the belts 166 define the passage for the sheets 168 underneath the upper laminar guide 169 between the section of output 24*r* and the input section 24*l*.

The insertion device 162 includes a counter plate 170, coupable with the external section of the support plate 164. In detail, the counter plate 170 supports small balls 157, of known type, lodged in respective cylindrical seats above the belts 153 and spring urged against the belts 166 to improve the transport of the sheets 146. Internally to the equipment 161, the belts 166 allow the device 162 to transfer, without change of direction, sheets 168 having transversal dimensions less of the distance between the sides 24*l* and 24*r* of the frame 122*l* and, particularly, A5 sheets in the sense of the long edge.

On control of the electronic processing unit 133 and without mechanical interventions, the equipment 161 can longitudinally introduce the sheets 26 and move the sheets along the second direction 129 with change of direction, or receive and transversally transfer the sheets 168 without change of direction. Possible jams can be removed, by accessing the plate 164 and the belts 166 in the condition of service of the frame 122*h*.

For transversally transfer sheets 171 of small dimensions, the equipment 161 can use a lengthened counter plate (not shown) which extends along the external section and the internal section of the device 162. The small balls 157*r* are also arranged along the internal section of the equipment for improving the transport of the sheets 146 along the whole extension of the plate 164 and of the belts 166. The lengthened counter plate is coupable with the support plate 164 and with the belts 166 in the condition of service of the frame 122*h*, while the equipment 161 is operative exclusively for the transfer of the sheets 171 without change of direction.

Figure 11:
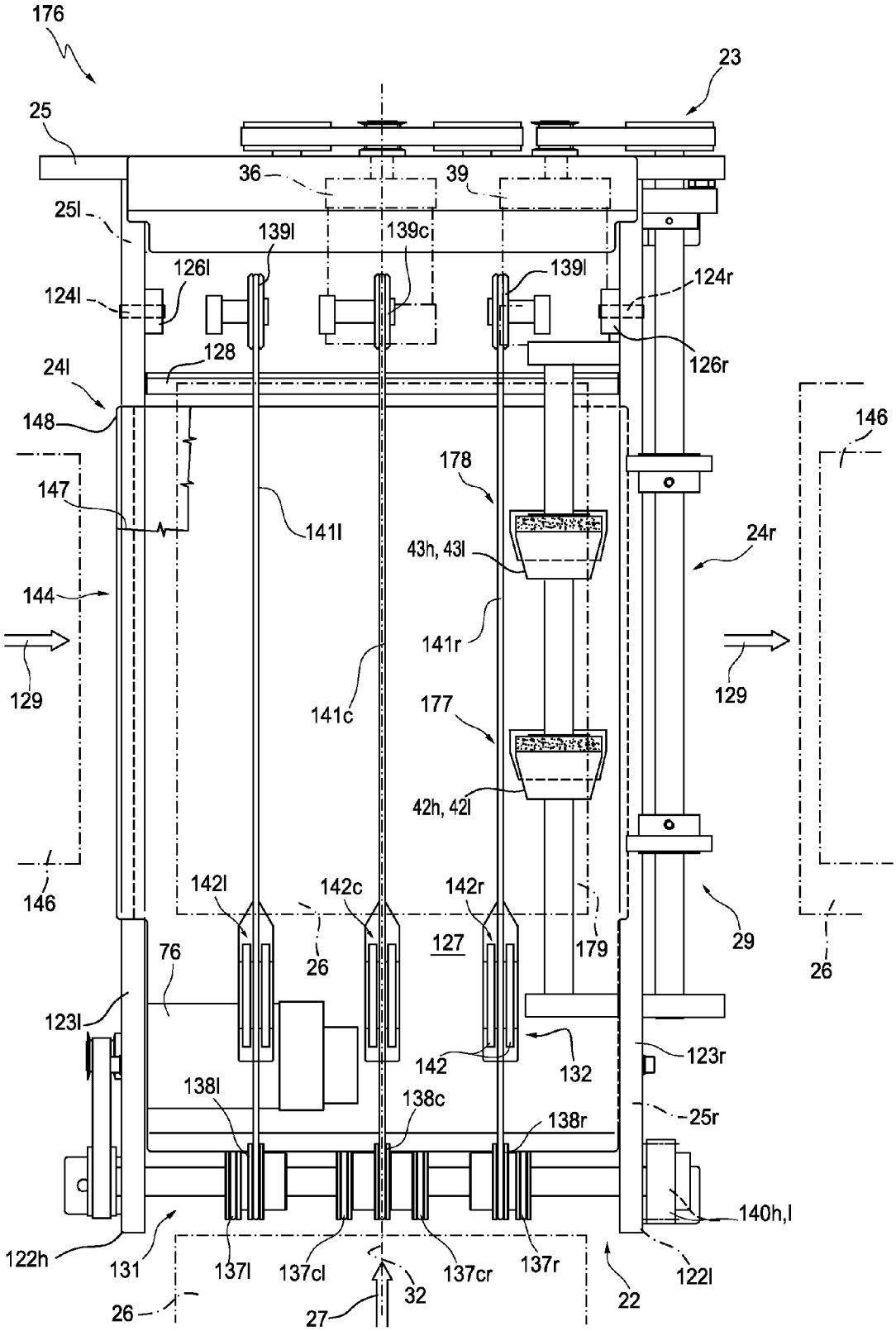
FIG. 11 is a plan view of a further variant of the equipment of FIG. 1.

An equipment for transferring sheets 176, similar to the equipment 121 or 161 is shown in FIG. 11. The equipment 176 includes the longitudinal moving device 131 with "O" rings and the pulleys of lifting, the output rollers 29 adjacent to the section 24*r* and the transversal guide elements 144. On the contrary, the equipment 176 has a different arrangement for the members of engagement and movement, herein represented with 177 and 178.

The members 177 and 178 are similar to the members 33 and 34 and comprise the pair of opposite wheels 42*l* and 42*h* and the pair of opposite wheels 43*l* and 43*h* actuatable between the condition of reception and the condition of engagement and movement for the sheets 26. The members of engagement and movement 177 and 178 are arranged parallel to the output rollers 29 between the "O" rings and the output rollers and operate on areas of the sheets 26 adjacent to a lateral edge 179. The guide elements 144 have lateral openings for the members 177 and 178 and guide the sheets 146 through the space of reception between the wheels 42*l*, 42*h* and 43*l*, 43*h*, up to the output rollers 29, for the moving of the sheets along the second direction.

In the operative conditions for the transferring of the sheets 26, the equipments 121, 161, 176 is in a condition of reception and in which the motor 76 is energized for the actuation of the "Or" ring 141*l*, 141*c* and 141*r*. The output motor 36 is also energized and holds in continuous rotation the output rollers 29. In turn, the shaped wheels 42*l* and 43*l* are in the reference position A sheet 26 entering the input section 22 is nipped and moved by the pulleys 137*l*, 137*c* and 137*r* and the pulleys 138*l*, 138*c* and 138*r* and subsequently moved by the lower branches of the "O" rings along the surface 127. Then, through the small sides 143, the "O" rings lift the input edge of the entering sheet 26 and allow the sheet to fall on the surface 127 to overlap, without jamming, following entering sheets on a sheet or on preceding sheets, arranged on the surface 127. Subsequently, the "O" rings move the sheet on the surface 127, up to the stop against the surface 128. Upon the passage of the edge of output in front of the sheet sensor, the processing unity energizes the actuating motor for the cyclical rotation of 180 degrees of the wheels 42*l*, 42*h* and 43*l*, 43*h*.

It occurs jointly with the input of the input edge 52 of the sheet 26 in the space of reference between the wheels 42*l* and 42*h* and the wheels 43*l* and 43*h*. In the equipments 121, 161, the shaped wheels 42*l* and 43*l* engage in tandem two areas of the sheet adjacent to the input edge 52. During the shifting of the sheet 26 in the second direction, the equipment can receive a following sheet 26. The input edge 52 of the incoming sheet is lifted for the combined action of the "O" rings 141*l*, 141*c* and 141*r* and the contrast pulleys 142*l*, 142*c* and 142*r*. Thereafter, the input edge 52 is depressed with partial superimposition on the sheet 26 lying on the reference surface 127 and in output. While the preceding sheet has completely abandoned the engagement with the "O" rings, the following sheet is inserted in the spaces of reception for a new activation of the actuating motor, upon the passage of the edge of output of the sheet in front of the sheet sensor, for another cycle of transferring.

In the equipment 176, the wheels 42*l* and 43*l* engage areas of the lateral edge 179 adjacent to the section 124*r*. The sheet 26 is moved in the second direction up to the engagement of the lateral edge 179 with the output rollers 29 for the transport in the direction 129 and while the wheels 42*l* and 43*l* return in the condition of receipt. Also in the equipment 176 is possible to receive a sheet 26 during the shifting of the sheet 26 in the second direction, up to the time in which the preceding sheet has not completely abandoned the engagement with the wheels 42*l* and 42*h* and the wheels 43*l* and 43*h*.

The transferring of sheets above described it is also applied to the case in which instead of a single sheet two overlapped sheets are received, as in the case in which the equipment 121, 151, 176 is arranged downstream of a double cutter.

Naturally, the principle of the invention remaining the same, the embodiments and the details of construction of the equipment for transferring sheets with change of direction can be widely varied with respect to what has been described and illustrated, by way of non-limitative example, without by this departing from the ambit of the present invention.

We claim:

1. Equipment for transferring sheets with change of direction for sheets entering along a first direction, comprising:

output rollers for moving entered sheets along a second direction right-angled with respect to the first direction;

a pair of opposite wheels or more pairs of opposite wheels actuatable in the rotation for engaging and moving, along the second direction, the sheets entering along the first direction; and an actuating motor for cyclically actuating the pair of opposite wheels or the pairs of opposite wheels;

wherein at least one wheel of the pair of opposite wheels or of each pair of opposite wheels has an engagement sector or more engagement sectors for engaging the other wheel and a depressed sector or more depressed sectors; and wherein the depressed sector or each depressed sector is faced to the other wheel of the pair in a reference position to define a condition of receipt for the entering sheets, while the engagement sector or each engagement sector is designed for engaging and moving the entering sheets in a condition of engagement and movement;

the actuating motor being provided for actuating said at least one wheel from the reference position to positions of engagement and movement for engaging and moving the entered sheets up to the engagement with the output rollers and return to the reference position, and each sheet entered along the first direction being moved by the engagement sector or by the engagement sectors, while a following sheet being allowed to enter and to be moved along a first direction up to the space defined by the depressed sectors for a new transferring of the sheets, jointly with the movement along the second direction of a sheet engaged by the output rollers, wherein the pair of opposite wheels or each pair of opposite wheels are in condition of synchronism and comprise each one a substantially frusto-conical tapered surface for the sheet in receipt, and wherein the other wheel of the pair of opposite wheels or each other wheel of the pairs of opposite wheels, comprises a coating configured to provide high adherence.

2. Equipment for transferring sheets with change of direction for sheets entering along a first direction comprising, said equipment, comprising:

output rollers for moving entered sheets along a second direction right-angled with respect to the first direction; and members of engagement and movement actuatable for engaging and moving the sheets entering along the first direction along the second direction up to the engagement with the output rollers;

said members of engagement and movement providing a condition of reception defining a space of reception for entering sheets and a condition of engagement and movement wherein said members of engagement and movement engage the entered sheets and move the entered sheets for the engagement with the output rollers; and wherein said members of engagement and movement return to the condition of reception upon the engagement of the entered sheet with the output rollers for enabling a following sheet to enter and to be moved along the first direction jointly with the movement of the previous entered sheet along the second direction, wherein said members of engagement and movement comprise shaped rollers and wherein said shaped rollers are cyclically actuatable, in the rotation, between a reference position in which define the space of reception and positions of engagement for engaging and moving the entered, wherein said shaped rollers include a pair of opposite wheels or more pairs of opposite wheels and at least a wheel of the pair of opposite wheels or of each pair of opposite wheels has an engagement sector or more sectors and a depressed sector or more depressed sectors, and wherein the engagement sector or each one of the engagement sectors is designed for engaging the other wheel, the depressed sector or each depressed sector being designated to face the other wheel of the pair of opposite wheels or of each pair of opposite wheels, spaced apart said space of reception for defining the condition of receipt, while the engagement sector or each one of the engagement sectors being designated for engaging the entering sheets in contrast with the opposite wheel and moving the entering sheets in the condition of engagement and movement;

wherein the pair of opposite wheels or each pair of opposite wheels are in condition of synchronism and comprise each one a substantially frusto-conical tapered surface for the sheet in receipt, and wherein the other wheel of the pair of opposite wheels or each other wheel of the pairs of opposite wheels, comprises a coating configured to provide high adherence.

3. Equipment for transferring sheets according to claim 2, wherein the output rollers are arranged, parallel to the first direction, out of the trajectory of the entering sheets in movement along the first direction, and wherein said output rollers are in continuous rotation and move, in the second direction, the moving sheets jointly with the engagement of said sheets in movement.

4. Equipment for transferring sheets according to claim 2 further including a stop surface for an input edge of the sheet entering along the first direction and wherein said shaped rollers include two pairs of opposite wheels, said pairs of opposite wheels being in condition of synchronism and being designated for operating on two areas adjacent to said input edge jointly with the arrival of said input edge adjacent to or against said stop surface.

5. Equipment for transferring sheets according to claim 2, wherein the sheet entering along the first direction has a lateral edge close to the output rollers, said equipment further including a stop surface for an input edge of the entering sheet and wherein said shaped rollers include two pairs of opposite wheels, said pairs of opposite wheels being in condition of synchronism and being designated for operating on two areas adjacent to the lateral edge of the entering sheet jointly with the arrival of said input edge adjacent to or against said stop surface.

6. Equipment for transferring sheets according to claim 2 further including a sheet sensor arranged upstream of the members of engagement and movement and an electronic processing unit, wherein said sheet sensor is designated for revealing the arrival of the sheet entering along the first direction and wherein said electronic processing unit responds to a signal or signals from said sheet sensor for controlling the members of engagement and movement in order to transfer, along the second direction, the received sheet or more received sheets.

7. Equipment for transferring sheets according to claim 2, wherein said shaped rollers are actuatable for a given sense of rotation or for an opposite sense of rotation, and wherein said output rollers are arranged at two sides of the equipment and have sense of rotation opposed for transferring the sheets through a given side of the equipment in association with the given sense of rotation of the shaped rollers, or through a side of the equipment opposed to said given side, in association with the opposite sense of rotation of said shaped rollers.

* * * * *